United States Patent [19]

Jackman et al.

[11] Patent Number: 4,533,801

[45] Date of Patent: Aug. 6, 1985

[54] INERTIA SWITCH DEVICE

[75] Inventors: Peter R. Jackman, Basingstoke; Alan D. Thomas, Reading, both of England

[73] Assignee: First Inertia Switch Limited, England

[21] Appl. No.: 522,154

[22] PCT Filed: Dec. 8, 1982

[86] PCT No.: PCT/GB82/00347

§ 371 Date: Jul. 26, 1983

§ 102(e) Date: Jul. 26, 1983

[87] PCT Pub. No.: WO83/02196

PCT Pub. Date: Jun. 23, 1983

[30] Foreign Application Priority Data

Dec. 15, 1981 [GB] United Kingdom ..... 8137716

[51] Int. Cl.[3] ..... H01H 35/14

[52] U.S. Cl. ..... 200/61.45 R; 200/61.45 M

[58] Field of Search ..... 200/61.45 R, 61.45 N, 200/61.52

[56] References Cited

U.S. PATENT DOCUMENTS

| | | | |
|---|---|---|---|
| 2,253,957 | 8/1941 | Kammerdiner | 200/52 |
| 3,066,202 | 11/1962 | Kaleba et al. | 200/61.5 |
| 3,832,507 | 8/1974 | Marquardt et al. | 200/61.45 R |
| 4,020,302 | 4/1977 | Hasegawa et al. | 200/61.45 R |
| 4,326,111 | 4/1982 | Jackman | 200/61.45 R |
| 4,371,763 | 2/1983 | Jackman et al. | 200/61.52 X |

FOREIGN PATENT DOCUMENTS

| | | |
|---|---|---|
| WO79/00500 | 8/1979 | PCT Int'l Appl. . |
| 826735 | 1/1960 | United Kingdom . |
| 2053569 | 2/1981 | United Kingdom . |

*Primary Examiner*—G. P. Tolin

*Attorney, Agent, or Firm*—Shapiro and Shapiro

[57] ABSTRACT

Movement of an inertia mass (4) from a rest position as a result of acceleration or deceleration in excess of a given threshold value causes a hinge-like assembly (8) having two parts (9 and 10) to pivot between two over-center positions on either side of a center position in which the two parts (9 and 10) occupy a common plane to thereby cause movable electrical contacts (14 and 15) forming part of the hinge-like assembly (8) to engage or separate from further electrical contacts (31 and 32).

11 Claims, 12 Drawing Figures

INERTIA SWITCH DEVICE

TECHNICAL FIELD OF THE INVENTION

This invention relates to an inertia switch device and concerns such a device for opening or closing electrical contacts in response to an acceleration or deceleration attaining a predetermined threshold value.

BACKGROUND ART

Devices of this kind are known in which an inertia mass, held in an inoperative position by a spring or magnet, is freed by an acceleration or deceleration of predetermined intensity to effect the opening or closing of electrical contacts. However, the mechanism which is actuated by the inertia mass to open or close the electrical contacts tends to be a complex mechanism having a relatively large number of parts. Therefore, not only do these parts have to be made to strict manufacturing tolerances, thus adding to the cost of the inertia switch device, but also the reliability of the inertia switch device tends to decrease in proportion to the number of parts required. Moreover, the complexity of the mechanism adds to the bulk and weight of the device.

DISCLOSURE OF THE INVENTION

An object of the invention is to simplify the mechanism which is actuated by the inertia mass.

According to the present invention an inertia switch device comprises a hinge-like assembly arranged to pivot between two over-centre positions on either side of a centre position in which two parts of the hinge-like assembly occupy a common plane, the hinge-like assembly either carrying or constituting a movable electrical contact which either engages or is separated from a further electrical contact when the hinge-like assembly pivots from one over-centre position to the other, and an inertia mass which is movable from a rest position when the device is subjected to an applied acceleration or deceleration exceeding a threshold value to cause the hinge-like assembly to move from one over-centre position to the other and operate the movable contact.

The inertia switch device may include resilient biasing means arranged to urge the hinge-like assembly towards the two over-centre positions. The resilient biasing means may comprise a spring extending between the two parts of the hinge-like assembly.

The inertia mass may be arranged to strike the hinge-like assembly directly to cause the hinge-like assembly to move from one over-centre position to the other.

Alternatively, the inertia mass may be arranged to strike a support structure on which the hinge-like assembly is mounted to cause the hinge-like assembly to move from one over-centre position to the other. The support structure may comprise a base having two upstanding members provided with slots in which the hinge-like assembly is mounted.

Preferably the inertia mass is a ball accommodated in a conical seat located below the hinge-like assembly. The inertia mass may include magnetic material and be restrained in the rest position by the attraction of a permanent magnet.

Conveniently, the hinge-like assembly and the inertia mass may be enclosed by a housing which also accommodates the further electrical contact.

A reset member may be arranged to return the hinge-like assembly from one over-centre position to the other, and the reset member may be arranged to provide a visual indication that the movable contact has been operated.

BRIEF DESCRIPTION OF THE DRAWINGS

Embodiments of the invention will now be described, by way of example, with reference to the accompanying drawings in which.

BEST MODES FOR CARRYING OUT THE INVENTION

Figure 1:
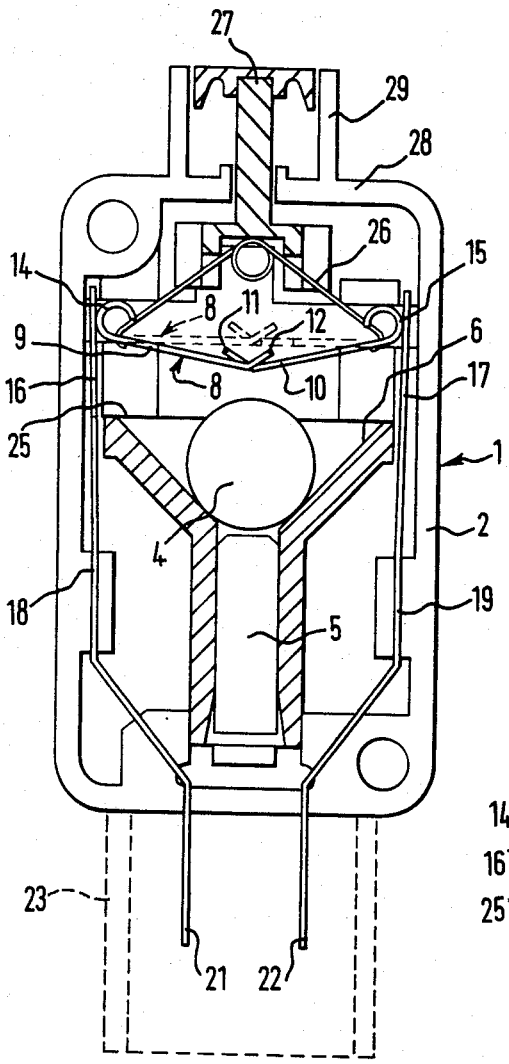
FIG. 1 is a front elevation, partly in section, of an inertia switch device in accordance with the invention with one part of a housing removed.
Figure 2:
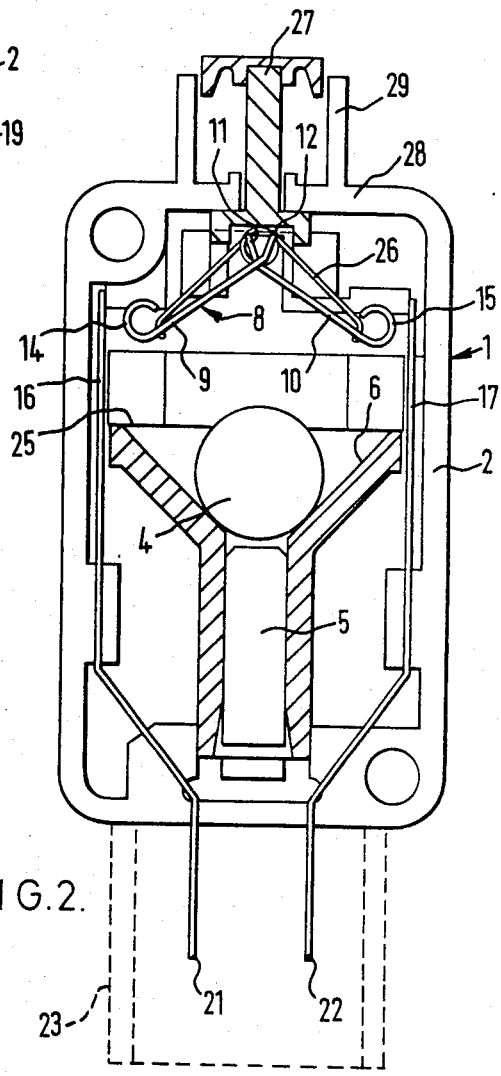
FIG. 2 is a front elevation similar to FIG. 1 but with the electrical contacts in a different position to that shown in FIG. 1.
Figure 3:
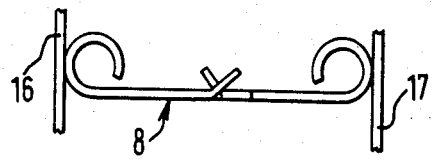
FIG. 3 is a fragmentary front elevation of the hinge-like assembly shown in FIG. 1 but in the centre position.

Referring in the first instance to FIGS. 1 to 3, the inertia switch device comprises a housing 1 moulded from electrically insulating material and having two similar parts which fit together, of which one part 2 is seen in the Figures. The housing 1 accommodates an inertia mass 4 in the form of a spherical steel ball which is normally restrained by a magnet 5 in a frusto-conical seat 6. The force exerted by the magnet 5 on the inertia mass 4 is such that it is overcome by the attainment of a predetermined threshold value of acceleration or deceleration acting on the device and thus on the inertia mass 4. When this threshold value is attained the inertia mass 4 moves upwards out of the seat 6.

Located above the inertia mass 4 is a hinge-like assembly 8 formed by two plates 9 and 10 of electrically conductive material such as brass pivotally connected together at mutually interfitting castellated edges 11 and 12. The outer edges of the two plates, which extend parallel to the interfitting edges 11 and 12, are turned over to form movable electrical contacts 14 and 15 which co-operate with respective fixed electrical contacts 16 and 17 mounted on opposite sides of the housing 1. The fixed contacts 16 and 17 are anchored in respective slots 18 and 19 in the sides of the housing 1 so that their upper ends normally bear against the movable contacts 14 and 15 when the inertia mass 4 is restrained within the frusto-conical seat 6 by the magnet 5. The lower ends of the contacts 16 and 17 form respective terminals 21 and 22 which are enclosed by a cover 23. The hinge-like assembly 8 is arranged to pivot between two over-centre positions on either side of a centre position shown in broken line in FIG. 1 in which the two plates 9 and 10 occupy a common plane above and parallel to the rim 25 of the frusto-conical seat 6. When in the lower of these over-centre positions, as seen in full line in FIG. 1, the hinge-like assembly 8 is urged towards the inertia mass 4 by a spring 26 anchored in holes in the two plates 9 and 10. When in the upper of these over-centre positions, as seen in FIG. 2, the hinge-like assembly 8 is urged by the spring 26 towards a reset plunger 27 slidably mounted in the top 28 of the housing 1. The reset plunger 27 is surrounded by a shroud 29.

In use of the device in an electrical circuit to release the electrically operated door locks of a vehicle such as an automobile, or to disconnect a source of electrical potential from an electrically operated fuel pump of a vehicle, the device is mounted in an upright position in the vehicle and the terminals 21 and 22 are connected in the electrical circuit concerned. Initially the hingelike assembly 8 would be in the position shown in full line in FIG. 1 so that the fixed contacts 16 and 17 are electrically interconnected by the movable contacts 14 and 15 and the plates 9 and 10. Although the term 'fixed contacts' has been used in the foregoing description it will be appreciated that the inherent resilience of the contacts 16 and 17 allows sufficient movement to provide adequate contact pressure at all times.

If the vehicle is involved in an accident so that an acceleration or deceleration above the predetermined threshold value is applied to the device then the inertia mass 4 will ride up the frusto-conical seat 6 and strike the underside of the hinge-like assembly 8. The impact of the inertia mass 4 with the plates 9 and/or 10 causes the plates to move upwards beyond the centre position shown in broken line in FIG. 1 and into the position shown in full line in FIG. 2. The spring 26 retains the hinge-like assembly 8 in this position so that the movable contacts 14 and 15 are separated from the fixed contacts 16 and 17 and the electrical circuit is broken. At the same time the reset plunger 27 is moved upwards so that its upper end projects out of the shroud 29 thus providing a visual indication that the electrical circuit has been broken.

The device can be reset by depressing the reset plunger 27 into the shroud 29 thus returning the hinge-like assembly 8 to its original over-centre position as shown in full line in FIG. 1 with the movable contacts 14 and 15 in engagement with the fixed contacts 16 and 17. Thus the electrical circuit can be re-connected as and when required.

Figure 7:
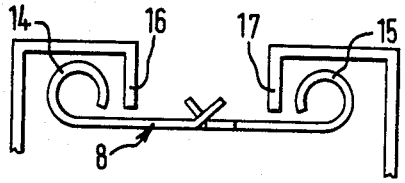
FIG. 7 is a fragmentary front elevation of another hinge-like assembly.
Figure 4:
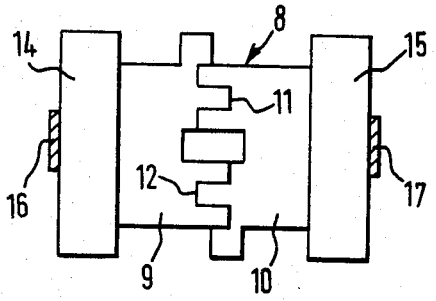
FIG. 4 is a plan view of the hinge-like assembly shown in FIG. 1.
Figure 8:
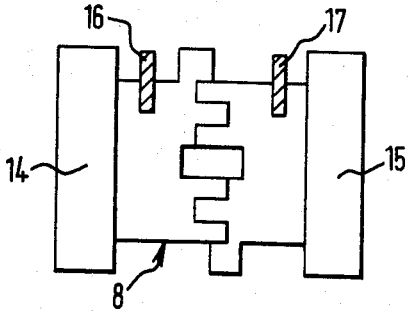
FIG. 8 is a plan view of the hinge-like assembly shown in FIG. 7.
Figure 5:
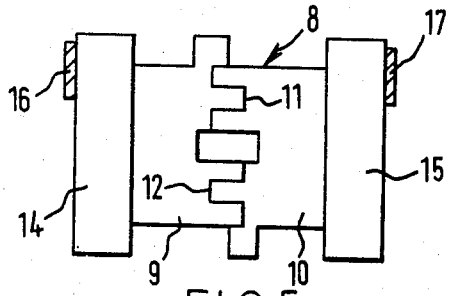
FIGS. 5 and 6 are plan views similar to FIG. 4 but with the fixed contacts located in different positions.
Figure 9:
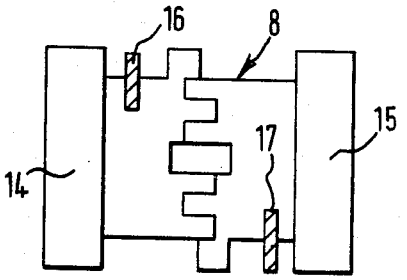
FIGS. 9 and 10 are plan views similar to FIG. 8 but with the fixed contacts located in different positions.
Figure 6:
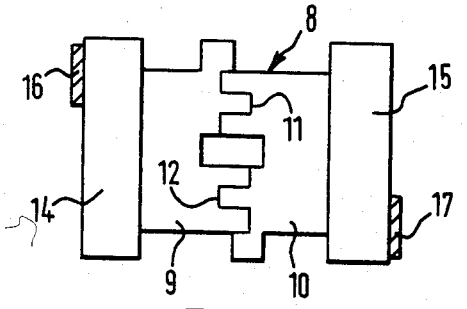
Figure 10:
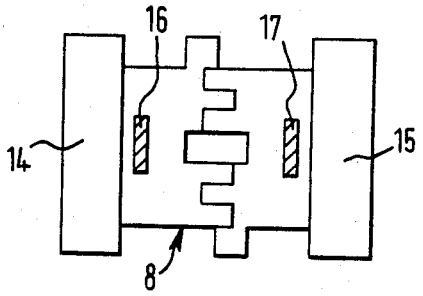

While the fixed contacts 16 and 17 would usually be located midway along the movable contacts 14 and 15 as shown in FIG. 4, they can equally well be located in the positions shown in FIGS. 5 and 6. Moreover, while the fixed and movable contacts shown in FIG. 1 to 6 are normally closed contacts which open on impact the fixed and movable contacts could equally well be normally open contacts which close on impact. As shown in FIGS. 7 and 8 the hinge-like assembly 8 is arranged so that the movable contacts 14 and 15 are normally separated from the fixed contacts 16 and 17. FIGS. 9 and 10 show alternative positions for the fixed contacts 16 and 17.

Figure 11:
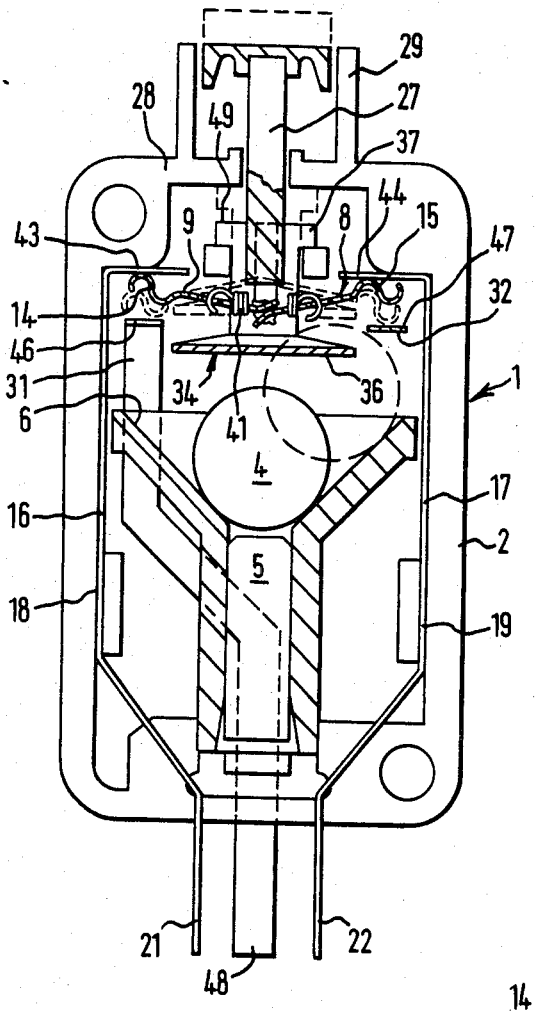
FIG. 11 is a front elevation, partly in section of another inertia switch in accordance with the invention with one part of the housing removed.
Figure 12:
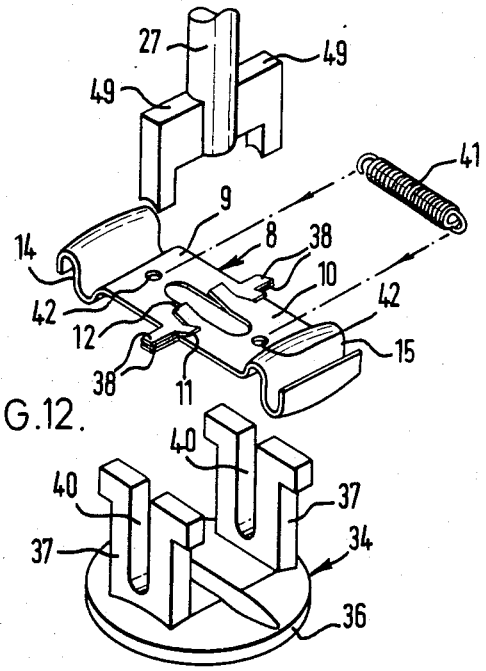
FIG. 12 is an exploded perspective view of the hinge-like assembly shown in FIG. 11.

Turning now to FIG. 11 and 12, the inertia switch device comprises a housing 1 moulded from electrically insulating material having two similar parts which fit together of which one part 2 is shown in the Figures. As before the housing 1 accommodates an inertia mass 4 in the form of a spherical steel ball which is normally restrained in a frusto-conical seat 6 by a magnet 5.

Located above the inertia mass 4 is a hinge-like assembly 8 formed by two plates 9 and 10 of brass which are pivotally connected together at mutually interfitting edges 11 and 12. The outer edges of the two plates which extend parallel to the interfitting edges 11 and 12 are bent into a sinuous shape to form movable contacts 14 and 15 which cooperate with respective fixed electrical contacts 16 and 17 and also with fixed electrical contacts 31 and 32 in a change-over contact assembly.

The hinge-like assembly 8 is supported for pivotal movement in a support structure 34 of electrically insulating material comprising a circular base 36 and two substantially U-shaped members 37 upstanding from the base 36. Projecting ears 38 at either side of the two plates 9 and 10 rest within the slots 40 between the two arms of the U-shaped members 37 which act as guides for the ears 38 to allow pivotal movement of the hinge-like assembly 8 between its two over-centre positions. The hinge-like assembly 8 is urged towards these over-centre positions by a helical spring 41 having its ends anchored in holes 42 in the plates 9 and 10.

The fixed contacts 16 and 17 are anchored in respective slots 18 and 19 in the sides of the housing 1 and their respective upper ends 43 and 44 are bent horizontally so that they overlie the movable contacts 14 and 15. The lower ends of the fixed contacts 16 and 17 form respective terminals 21 and 22. The fixed contacts 31 and 32 are also anchored in the housing 1 and have upper ends 46 and 47 which are bent horizontally so that they lie below the movable contacts 14 and 15 and have lower ends which form terminals 48 of which one is shown. A reset plunger slidably mounted in the top 28 of the housing 1 is surrounded by a shroud 29. Two horizontally extending abutments 49 at the lower end of the reset plunger 27 act as stop members to limit the upward movement of the reset plunger 27.

In use of the device in an electrical circuit to release the electrically operated door locks of a vehicle and to disconnect a source of electrical potential from an electrically operated fuel pump of the vehicle the device is mounted in an upright position in the vehicle. The normal closed part of the change-over contacts are connected to the electrical circuit for the fuel pump by means of terminals 48 while the normally open part of the change-over contacts are connected to the electrical circuit for the door locks by means of the terminals 21 and 22.

If the vehicle is involved in an accident so that an acceleration or deceleration above the predetermined value is applied to the device then the inertia mass 4 will ride up the frusto-conical seat 6 and strike the underside of the circular base 36. The impact of the inertia mass 4 on the base 36 moves the hinge-like assembly 8 upwards and causes the plate 9 and 10 to move into the other over-centre position thus moving the movable contacts 14 and 15 away from fixed contacts 16 and 17 and into engagement with fixed contacts 31 and 32. The electrical circuit for the fuel pump is broken and the electrical circuit to operate the door locks is energised. At the same time the reset plunger 27 is moved upwards so that its upper end projects out of the shroud 29 thus providing a visual indication that the change-over contact assembly has bee operated.

The device can be reset by depressing the reset plunger 27 into the shroud 29 thus returning the hinge-like assembly 8 to its original over-centre position with the movable contacts in engagement with the fixed contacts 16 and 17 and separated from the fixed contacts 31 and 32.

While the inertia mass 4 in the embodiments of the invention described above is constituted by a spherical steel ball in a frusto-conical seat, since this form of inertia mass will respond to impact in any direction in a horizontal plane, in other embodiments of the invention other forms of inertia mass may be utilized. Moreover, although the inertia mass 8 is restrained by a magnet 5 in the embodiments of the invention described above, in other embodiments of the invention the inertia mass may be restrained by springs or other suitable means.

We claim:

1. An inertia switch device comprising:

an inertia mass (4) which is movable from a rest position when the device is subjected to an applied acceleration exceeding a threshold value;

spaced electrical contact means (16 and 17, and 31 and 32);

a hinge-like assembly (8) which is mounted independently of the inertia mass (4) and in which two parts (9 and 10) are connected for movement between two over-centre positions on opposite sides of a centre position in which the two parts (9 and 10) are aligned with a common plane, in response to movement of the inertia mass (4) when subjected to said applied acceleration; and movable electrical contact means (14 and 15) on at least part of the hinge-like assembly (8) and arranged to engage the spaced electrical contact means (16 and 17, and 31 and 32) when the hinge-like assembly (8) is in one of the over-centre positions;

characterized in that:

the spaced electrical contact means (16 and 17, and 31 and 32) comprise two first contacts (16 and 17);

the movable electrical contact means comprise two electrically connected movable contacts (14 and 15);

the hinge-like assembly (8) is mounted independently of the spaced electrical contact means (16 and 17, and 31 and 32) so that the movable contacts (14 and 15) are respectively movable into and out of contact with the two first contacts (16 and 17) so as to bridge the first two contacts (16 and 17); and resilient biasing means (26 or 41) are operable, on said movement of the inertia mass (4), to move the hinge-like assembly (8) from said one of the over-centre positions, in which the movable electrical contacts (14 and 15) engage the first electrical contacts (16 and 17, and 31 and 32), to the other of the over-centre positions, and are operable to releasably hold the hinge-like assembly (8) in said other of the over-centre positions.

2. An inertia switch device, as claimed in claim 1, wherein the spaced electrical contact means (16 and 17, and 31 and 32) comprise two first fixed contacts (16 and 17) and two second fixed contacts (31 and 32); the hinge-like assembly (8) is mounted between the two first fixed contacts (16 and 17) and between the two second fixed contacts (31 and 32) so that the movable contacts (14 and 15) are respectively movable out of contact with the two second fixed contacts (31 and 32) and into contact with the two first fixed contacts (16 and 17) so as to bridge the two first fixed contacts (16 and 17) and are respectively movable out of contact with the two first fixed contacts (16 and 17) and into contact with the two second fixed contacts (31 and 32) so as to bridge the two second fixed contacts (31 and 32).

3. An inertia switch device, as claimed in claim 1, wherein the resilient biasing means (26 or 41) comprise a spring extending between the two parts (9 and 10) of the hinge-like assembly (8).

4. An inertia switch device, as claimed in claim 1, wherein the inertia mass (4) is arranged to strike the hinge-like assembly (8) directly to cause the hinge-like assembly (8) to move from one over-centre position to the other.

5. An inertia switch device, as claimed in claim 1, wherein the inertia mass (4) is arranged to strike a support structure (34) on which the hinge-like assembly (8) is mounted to cause the hinge-like assembly (8) to move from one over-centre position to the other.

6. An inertia switch device, as claimed in claim 5, wherein the support structure (34) comprises a base (36) having two upstanding members (37) provided with slots (40) in which the hinge-like assembly (8) is mounted.

7. An inertia switch device, as claimed in claim 1, wherein the inertia mass (4) is a ball accommodated in a conical seat (6) located below the hinge-like assembly (8).

8. An inertia switch device, as claimed in claim 1, wherein the inertia mass (4) includes magnetic material and is restrained in the rest position by the attraction of a permanent magnet (5).

9. An inertia switch device, as claimed in claim 1, wherein the hinge-like assembly (8) and the inertia mass (4) are enclosed by a housing (1) which also accommodates the spaced electrical contact means (16 and 17, and 31 and 32).

10. An inertia switch device, as claimed in claim 1, wherein a reset member (27) is arranged to return the hinge-like assembly (8) from one overcentre position to the other.

11. An inertia switch device, as claimed in claim 10, wherein the reset member (27) is arranged to provide a visual indication that the movable contact (14 and 15) has been operated.

* * * * *